US005335896A

United States Patent [19]

Idstein et al.

[11] Patent Number: 5,335,896

[45] Date of Patent: Aug. 9, 1994

[54] NOZZLE INSERT FOR A STEELMAKING LADLE

[75] Inventors: Donald J. Idstein, Valparaiso, Ind.; John P. Hoffman, Coopersburg, Pa.; Harry J. Beesley, Valparaiso, Ind.

[73] Assignee: Bethlehem Steel Corporation, Bethlehem, Pa.

[21] Appl. No.: 25,543

[22] Filed: Mar. 3, 1993

[51] Int. Cl.[5] ..... B22D 41/50

[52] U.S. Cl. ..... 266/236; 222/591; 222/594

[58] Field of Search ..... 266/236; 222/591, 594

[56] References Cited

U.S. PATENT DOCUMENTS

| | | | |
|---|---|---|---|
| 685,964 | 11/1901 | Baldt | 222/591 |
| 1,072,972 | 9/1913 | Michaels | 222/591 |
| 1,099,769 | 6/1914 | Scheaffer | 222/591 |
| 1,747,530 | 2/1930 | Schaup | 222/591 |
| 2,252,635 | 8/1941 | Karr | 222/591 |
| 3,395,840 | 8/1968 | Gardner | 222/591 |
| 3,396,877 | 8/1968 | Osterholtz et al. | 222/591 |
| 4,037,769 | 7/1977 | Ruckstuhl | 222/591 |
| 4,176,769 | 12/1979 | Cubdy et al. | 222/591 |
| 4,177,943 | 12/1979 | Suzuki | 222/591 |
| 5,060,915 | 10/1991 | Altpeter et al. | 266/236 |

*Primary Examiner*—Scott Kastler

*Attorney, Agent, or Firm*—Harold I. Masteller, Jr.

[57] ABSTRACT

A two piece nozzle insert for use in a steelmaking ladle comprising a nozzle segment and a lock ring segment. The nozzle segment includes a prefired refractory block suited for insertion into the discharge bore of a ladle well block, and the lock ring segment includes a fastening means for removeably attaching the lock ring segment within the discharge bore of a ladle mounting plate. The nozzle segment and lock ring segment include cooperating tapered surfaces to provide a slip plane for compressing and extruding bonding material from between mortar joints of the two piece nozzle insert.

24 Claims, 3 Drawing Sheets

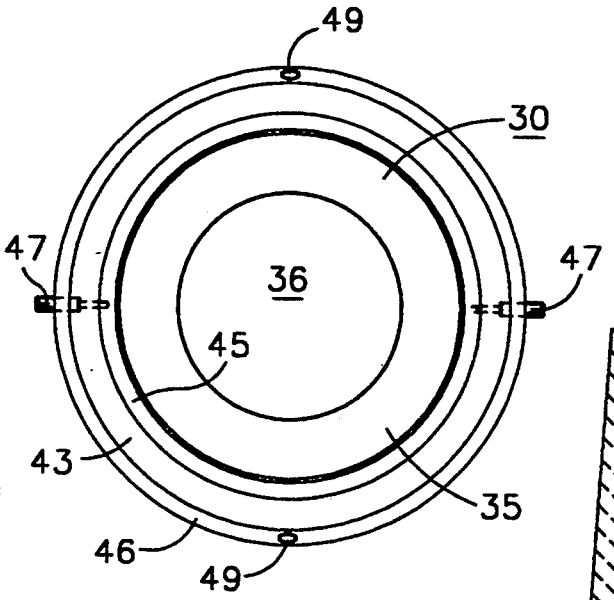
Fig. 4
Fig. 3
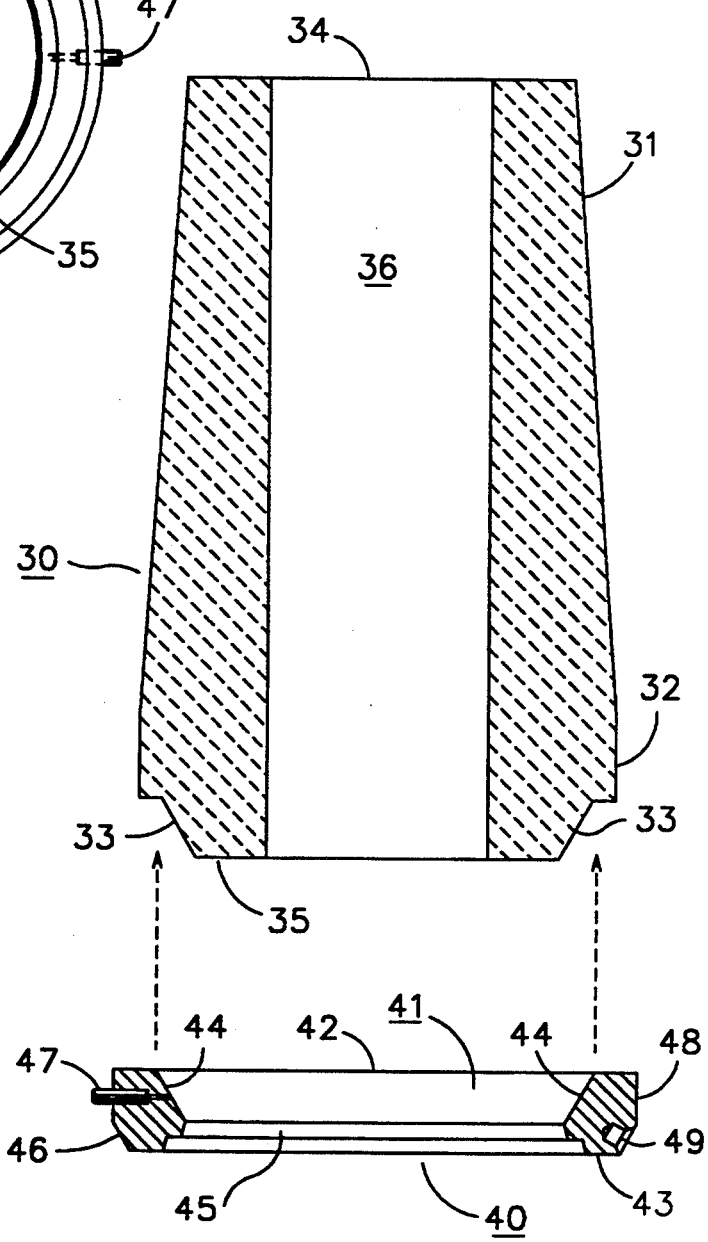

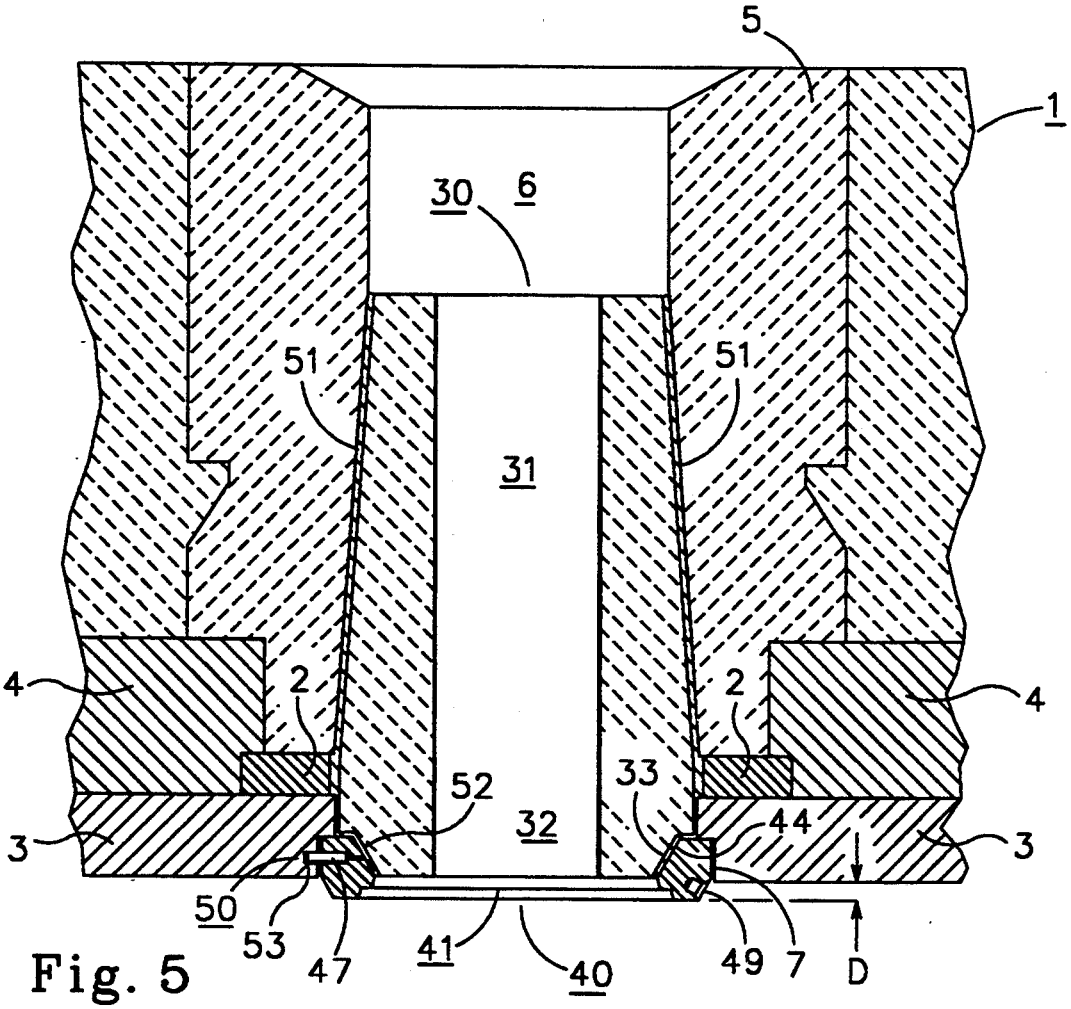
Fig. 5
Fig. 6
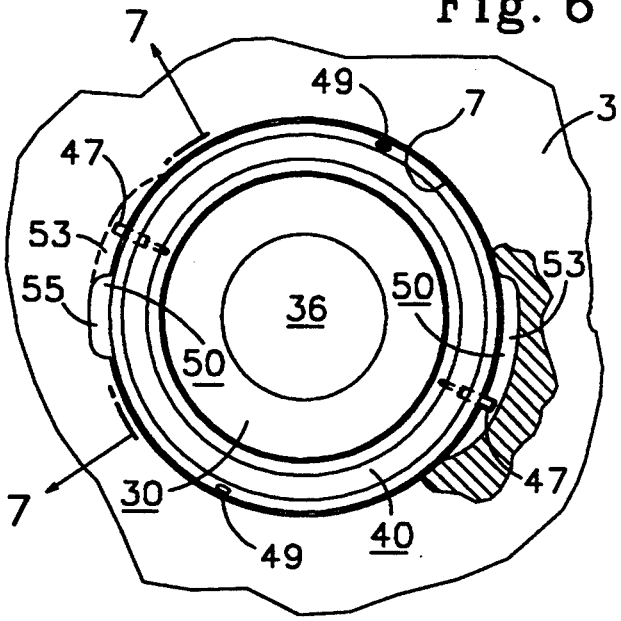
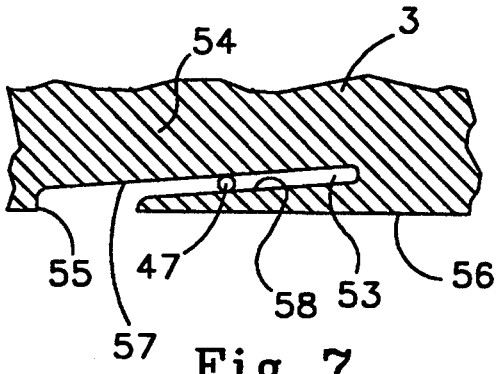
Fig. 7

NOZZLE INSERT FOR A STEELMAKING LADLE

BACKGROUND OF THE INVENTION

The present invention relates to molten metal discharge nozzles and in particular to discharge nozzles used in steelmaking ladles having slide gate valves for controlling the flow of molten metal from the ladle. Discharge nozzles normally comprise either gunned refractory material, or prefired refractory blocks fitted into the outlet of the ladle where molten metal is discharged. After repeated use, the abrasive nature of the molten metal causes the refractory discharge nozzles to erode to a point where they are no longer useful and they must be replaced.

Evolving improvements within the state of the art have led to the development of replaceable discharge nozzle inserts. These nozzle inserts comprise either one, or two piece prefired refractory shapes sized to fit within the bore of a ladle well block. The outside surfaces of such inserts are coated with a mortar to hold them in place within the bore. Replaceable nozzle inserts have been a significant improvement within the ladle art, and in general, they have met the needs of the industry. However, the inserts of the past are both difficult to install and replace.

During installation operations, the inserts am pushed into the discharge bore of a ladle, and excess mortar, applied to the surface of the insert, is forced outward to accumulate along the bore opening. The excess mortar builds up along the various edges of the bore opening and prevents proper seating of the nozzle insert.

Conversely, if a workman fails to apply a sufficient amount of mortar to the outside surface of a nozzle insert, gaps and bare spots are introduced into the mortar joint as the insert is pushed up into the ladle bore. Such defective motor joints provide access for the molten metal to permeate behind the nozzle insert and cause premature nozzle failure.

Finally, when these replaceable nozzle inserts become worn they require replacement. The mortar bond between the insert and the discharge bore must be broken to remove the insert. This procedure is both difficult and time-consuming, and jack hammer like tools must be used to accomplish the task. This removal operation often causes damage to the surrounding refractory lining of the ladle, and further lining repairs must be made before the ladle can be placed back into service. A further disadvantage of these past nozzle inserts is their tendency to be damaged by slide gate valve mechanisms. Requirements of the modern high production continuous caster have necessitated equipping steelmaking ladles with slide gate valves to more accurately control molten metal flow rates as the liquid steel is discharged into the caster tundish. With the increased use of these newer slide gate valves, it has been discovered that their moving parts cause damage to the refractory face of the past nozzle inserts. In order to overcome this problem, various nozzle insert designs were tried. One successful insert design included a two piece refractory/steel design where the lower steel insert portion engages the slide gate valve mechanism. However, due to its high weight, the heavy steel insert portion must provide a large surface area to enable the mortar joint to hold it in place. To provide the necessary mortar joint surface area, steel inserts of the past extend into the discharge bore area where slag sensors are normally located. This causes interference with the operation of the electromagnetic slag sensors and results in substandard product.

SUMMARY OF THE INVENTION

It is therefore an object of this invention to provide a ladle nozzle insert which simplifies installation and proper seating of a nozzle insert within a ladle discharge bore.

It is a further object of this invention to provide a ladle nozzle insert which simplifies the removal of a worn nozzle insert from a ladle discharge bore.

It is still a further object of this invention to provide a ladle nozzle insert resistant to damage by slide gate valve mechanisms.

And finally, it is an object of this invention to provide a ladle nozzle insert which will not interfere with the operation of slag sensor devices surrounding the discharge bore of a ladle.

We have discovered that the foregoing objects can be attained with a two piece nozzle insert having a nozzle segment and a lock ring segment, the lock ring segment including a bore and a lock means, the bore being adapted to cooperate with an undercut portion of the nozzle segment to provide a slip plane therebetween to compress and extrude mortar, and the lock means being adapted to cooperate with a corresponding lock means formed within the discharge bore of a ladle.

BRIEF DESCRIPTION OF THE DRAWINGS

FIG. 3 is an exploded view, in cross-section, showing the preferred embodiment of the ladle nozzle insert invention.

FIG. 4 is a bottom plan view of the locking portion of the ladle nozzle insert invention.

FIG. 5 is a cross-sectional view of the nozzle insert invention seated within the discharge bore of a steelmaking ladle.

FIG. 6 is a fragmentary view showing the locking mechanism of the ladle nozzle insert invention seated within the discharge bore of a steelmaking ladle.

FIG. 7 is a cross-sectional view taken along the lines 7—7 of FIG. 6.

DETAILED DESCRIPTION OF THE INVENTION

Figure 1:
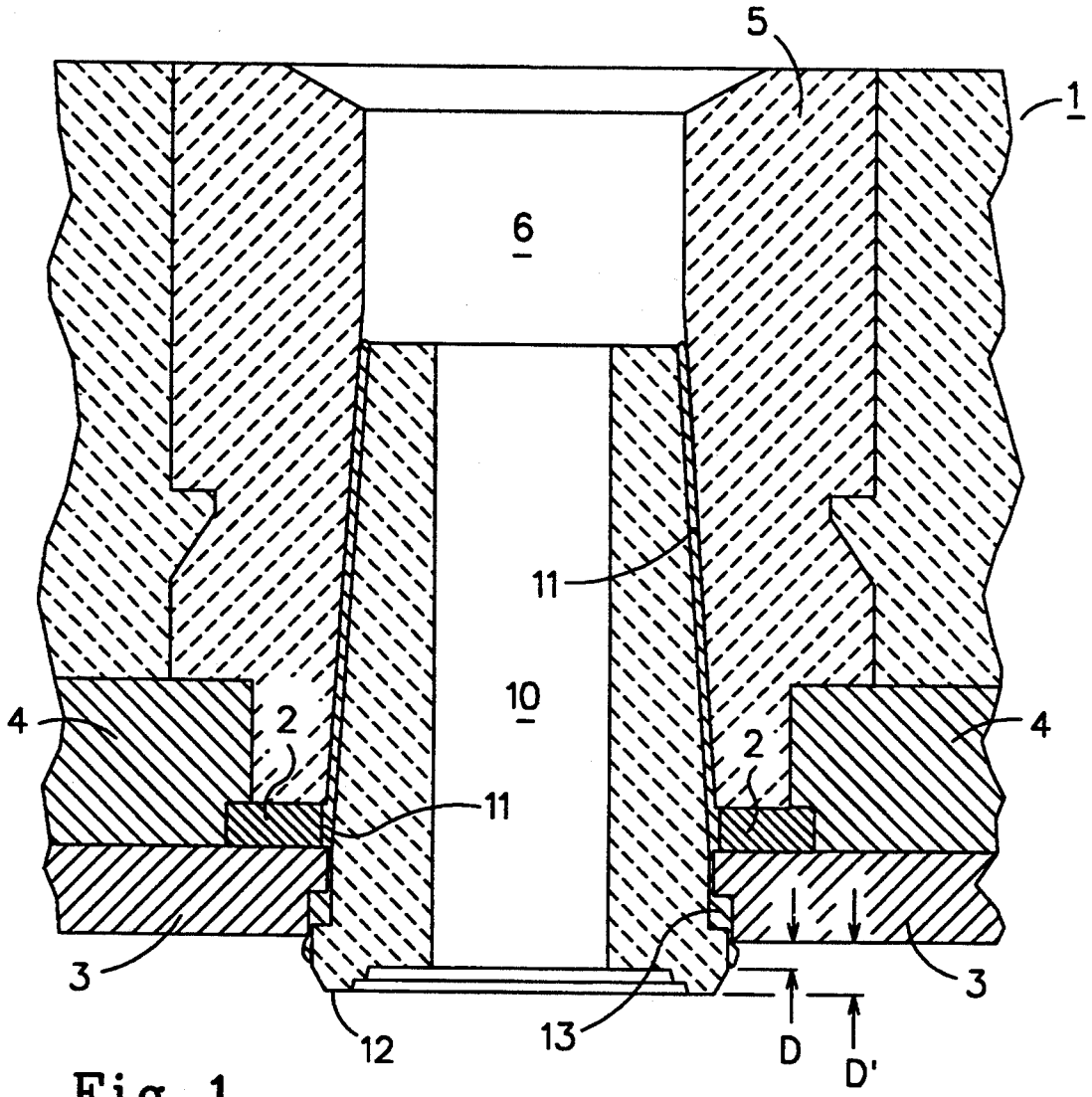
Fig. 1 PRIOR ART
FIG. 1 is a cross-sectional view of a one piece ladle nozzle insert of the past showing improper nozzle seating due to mortar buildup along the edge of a ladle discharge bore.

Referring to FIG. 1 labeled prior art, a steelmaking ladle is shown to comprise a ladle 1, a slag sensor device 2 encircling the discharge bore 6 or a well block 5, and a mounting plate 3 for receiving a slide gate valve (not shown). Mounting plate 3 is attached to the level plate 4 of the ladle shell, and a one piece refractory nozzle insert of the past, shown at 10, is positioned within the discharge bore 6 of the well block 5. The nozzle insert 10 is secured within the discharge bore by mortar 11, and its cold face 12 is shaped to accommodate the slide gate valve mechanisn used to control the discharge flow of liquid steel from the ladle.

Figure 2:
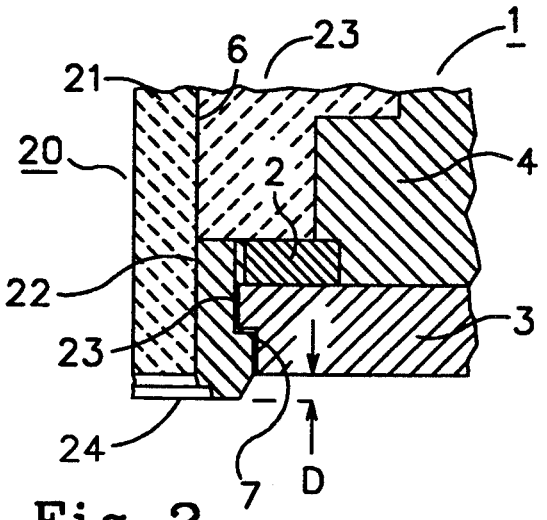
Fig. 2 PRIOR ART
FIG. 2 is a cross-sectional view of a portion of a two piece ladle nozzle insert of the past showing a metallic nozzle portion adjacent a ladle slag sensor device.

Such past nozzle inserts, as shown in FIG. 1, are difficult to seat properly within the ladle discharge bore. During installation, insert 10 is pushed into discharge bore 6 of the ladle and excess mortar, applied to the surface of the insert, is forced outward to accumulate along the bore opening. This excess mortar buildup 13, along the various edges of the bore opening, prevents proper seating of the nozzle insert. In order to properly receive the slide gate valve mechanism, the cold face 12 of insert 10 must extend beyond the bottom surface of the mounting plate to a given nozzle extension depth D, as shown in FIGS. 1 and 2. The excess mortar buildup 13 prevents proper seating of the insert and causes cold face 12 to extend beyond extension depth D to an improper depth D . This causes interference between the slide gate valve and the cold face, and the slide gate valve cannot be attached to the mounting plate. Additionally, the cold face of such past one piece nozzle inserts conceals mortar join 11 and prevents a final inspection of the mortar joint before the slide gate valve is installed. As a result, incomplete or defective mortar joints go undetected.

Referring to FIG. 2 of the drawings labeled prior art, a past two piece refractory/steel nozzle insert 20 is shown comprising an inner refractory portion 21 and an outer steel portion 22. Because such steel inserts are heavy, it is necessary to provide a large mortar joint surface area 23 to bind the heavy steel portion 22 to the ladle bore. For this reason, the heavy steel insert extends into the discharge bore to a location adjacent the bottom surface of well block 23. The steel insert extends through bore 7 of mounting plate 3, and provides a wear resistant cold face end 24 adapted to mate with the slide gate valve mechanism (not shown).

Refractory/steel nozzle inserts of the past have extended nozzle service life, however, they cannot be used with ladles equipped with slag sensor devices because the steel portion 22 extends into the ladle area where slag sensors 2 encircle the discharge bore. This causes interference with the sensor's electromagnetic fields.

Referring to FIGS. 3 and 4 of the drawings, the preferred embodiment of the present two piece nozzle insert invention, which overcomes problems and failures of the above prior nozzle inserts, is shown to include a nozzle segment 30 and a locking ring segment 40. The nozzle segment 30 comprises a prefired refractory shape having an upper portion 31 sized to fit within the discharge bore 6 of a ladle, a lower portion 32, a top surface 34, a bottom surface 35, and a nozzle discharge bore 36 extending between the top surface 34 and bottom surface 35.

The lower portion 32 of the nozzle segment includes an undercut portion 33 shaped for mating engagement with a bore extending through lock ring 40. Undercut 33 comprises a planer surface **33*a* extending along the periphery of the nozzle segment, and a tapered surface 33*b* extending in a downward direction from planer surface 33*a* to bottom surface 35**.

Lock ring 40 includes a top surface 42, a bottom surface or cold face 43, a bore 41 extending between the top surface 42 and bottom surface 43 and a tapered outside wall 46. The tapered outside said 46, bottom surface.. 43, and portions of bore 41 adjacent wall 46,are shaped to accommodate and engage the mechanism of a slide gate valve. Bore 41 also includes an inside wall surface 44 shaped to cooperate with tapered surface **33*b* of undercut 33** and provide a slip plane therebetween.

As used in this description and in the appended claims, the term "slip plane" refers to the sliding convergence between tapered surface **33*b* and inside wall surface 44 as the two tapered surfaces slip past each other during the installation of lock ring 40**, and to the resulting compressive force which extrudes bonding material interposed between the two surfaces.

Steel lock ring 40 further includes a lock means having one or more lock pins 47 extending in an outward direction from sidewall 48. Lock pins 47 are seated within apertures located within sidewall 48, and pins 47 extend outward for engagement with a corresponding lock means 50 provided within bore 7 of mounting plate 3. Apertures 49 are provided within tapered sidewall 46 of the lock ting to provide attachment means for a wrench type tool used to facilitate the engagement and disengagement of the lock means.

Referring now to FIGS. 4 through 6 of the drawings, the preferred embodiment of the nozzle insert invention is shown installed within the discharge bore 6 of a steelmaking ladle 1. The nozzle segment 30 is positioned within the discharge bore of the ladle well block, and the lock ring 40, is positioned within bore 7 of mounting plate 3 to which a slide gate valve (not shown) is attached. Prior to inserting the nozzle segment 30 into discharge bore 6, an even coating of mortar is applied to the outside surface of the insert. The nozzle insert is then rotated about its longitudinal axis as it is pushed up into bore 7. This axial rotation of insert 30 promotes a more uniform mortar joint 51 than if the insert were pushed into the bore using a straight, linear motion. As shown more clearly in FIG. 5, when the nozzle segment is properly seated within discharge bore 6, its upper elongated portion 31 is held in place by the uniform mortar joint 51, and its lower, shorter portion 32, extends in a downward direction into bore 7 of mounting plate 3. Excess mortar buildup, shown as 13 in FIG. 1, can now be removed from the outside edges of the bore opening to permit proper seating of the lock ring 40, and mortar joint 51 can be inspected prior to placement of lock ring 40 within bore 7.

Bore 7 includes a locking means 50 for attaching or removing the lock ring 40. The lock means comprises one or more circumferential grooves 53 cut into a portion of the bore wall shown as 54. Grooves 53 extend along a portion of wall 54, and the grooves are sloped to provide a continuous inclined plane in an upward direction toward the ladle. The continuous slope of grooves 53 enables lock pins 47 to be suitably positioned along the inclined plane to set bottom surface 43 at a proper depth "D" for engagement with the mechanism of the slide gate valve. Each circumferential groove includes a top surface 57, a bottom surface 58, and an aperture 55 extending between bottom surface 58 and the bottom surface 56 of plate 3. Top and bottom surfaces, 57 and 58, are spaced apart to receive a lock pin 47 extending from lock ring 40.

As shown in FIGS. 6 and 7, nozzle insert 40 is seated within bore 7 by placing lock pins 47 into apertures 55 to align pins 47 with their corresponding grooves 53. A wrench like tool is inserted into apertures 49 within tapered sidewalls 46, and lock ring 40 is rotated to engage pins 47 within their respective grooves 53. As lock ring 40 continues to be rotated, the slope of the inclined grooves 53 draws lock ring 40 into bore 7 to a proper ladle design depth D. A mortar joint 52, applied between the tapered surfaces 33 of the nozzle segment and 44 of the lock ring, compressed by the slip plane formed by the converging tapered surfaces **33*b* and 44. Excess bonding material or mortar is extruded from joint 52 by the compressive force of the slip plane, and the continuing dissemination of excess mortar enables proper seating of lock ring 40. The remaining mortar fills any gaps or irregularities between the two surfaces. Because pins 47 and grooves 53 provide a secure locking arrangement, the lock ring 40 can be securely seated without penetrating the discharge bore area encircled by the slag sensor 2**.

While this invention has been illustrated and described in accordance with a preferred embodiment, it is recognized that variations and changes may be made therein without departing from the scope of the invention as set forth in the claims.

We claim:

1. A two piece nozzle insert for use in a ladle comprising:

a) a nozzle segment including;

i) a first end having an outside surface corresponding to the shape of a well block bore, ii) a second end having an undercut portion including a planer surface extending along the periphery of said nozzle segment, and a tapered surface extending in a downward direction from said planer surface, and iii) a discharge bore extending between said first end and said second end, and b) a lock ring segment including;

i) a top surface corresponding to said planer surface of said undercut portion, ii) a bottom surface, iii) an aperture extending between said top surface and said bottom surface and including an inside wall surface corresponding to said tapered surface of said nozzle segment, and iv) a lock means for attaching said lock ring portion to said ladle, where said tapered surface and said corresponding inside wall surface converge and form a slip plane to provide a compressive force within a space extending between said planer surface and said corresponding top surface, and said tapered surface and said corresponding inside wall surface.

2. The invention recited in claim 1 wherein said slip plane compresses a bonding material, within said space, said slip plane providing means to extrude said bonding material from said space portion extending between said tapered surface and said corresponding inside wall surface.

3. The invention recited in claim 2 wherein said slip plane provides means to continuously extrude said bonding material from said space between said tapered surface and said corresponding inside wall surface until said bottom surface of said lock ring is set to a selected depth "D".

4. The invention recited in claim 1 wherein said nozzle segment is a nonmagnetic material.

5. The invention recited in claim 1 wherein said nozzle segment is a refractory material.

6. The invention recited in claim 1 wherein said lock ring segment is steel.

7. In a steelmaking ladle including an outer steel shell, an inner refractory lining having a well block, a mounting plate attached to said outer steel shell, and an slag sensor positioned between said well block and said mounting plate, the improvement comprising a two piece nozzle insert comprising:

a) a nozzle segment including;

i) a first end positioned within a bore extending through said well block, said first end being set in place with a bonding material interposed between said bore and said nozzle segment, ii) a second end extending past said slag sensor and including an undercut portion having a planer surface extending along the periphery of said second end of the nozzle segment, and a tapered surface extending in a downward direction from said planer surface, and iii) a discharge bore extending between said first end and said second end, and b) a lock ring segment including;

i) a top surface corresponding to said planer surface of said undercut portion, ii) a bottom surface, iii) an aperture extending between said top surface and said bottom surface and including an inside wall surface corresponding to said tapered surface, and iv) a lock means for attaching said lock ring portion to said ladle, where said tapered surface and said corresponding inside wall surface converge and form a slip plane to provide a compressive force within a space extending between said planer surface and said corresponding top surface, and said tapered surface and said corresponding inside wall surface.

8. The invention recited in claim 7 wherein said lock means comprises:

a) a male connector comprising two or more pins extending in an outward direction from said lock ring segment, and b) a female connector comprising two or more grooves shaped to receive said pins, each said groove formed within said bore extending through said mounting plate and including a first end communicating with a bottom surface of said mounting plate and a second end formed within said bore, each said groove being a continuous inclined plane extending in an upward direction from said first end to said second end.

9. The invention recited in claim 8 wherein said slip plane compresses and extrudes said bonding material from said space as said lock ring segment is rotated to advance said pins in an upward direction along said grooves.

10. The invention recited in claim 8 wherein said slip plane compresses and continuously extrudes said bonding material from said space as said lock ring segment is rotated to advance said pins in an upward direction along said grooves until said lock ring bottom surface is set to a selected depth "D".

11. The invention recited in claim 7 wherein said nozzle segment is a material which will not interfere with the operation of said slag sensor.

12. The invention recited in claim 7 wherein said nozzle segment is a refractory material.

13. The invention recited in claim 7 wherein said lock ring segment is steel.

14. A two piece nozzle insert for use in a ladle comprising:

a) a nozzle segment, b) a lock ring segment, and c) a slip plane within a joint extending between said nozzle segment and said lock ring segment, the slip plane providing means to compress and extrude a bonding material interposed between said nozzle segment and said lock ring segment.

15. The invention recited in claim 14 wherein said joint extends between a tapered surface extending in a downward direction from the periphery of said nozzle segment and a tapered inside wall surface extending along a bore within said lock ring portion.

16. A two piece nozzle insert for use in a ladle comprising:

a) a nozzle segment including;

i) a first end having an outside surface corresponding to the shape of a well block bore, ii) a second end having an undercut surface, and iii) a discharge bore extending between said first end and said second end, and b) a lock ring segment including;

i) a top surface, ii) a bottom surface, iii) an aperture extending between said top surface and said bottom surface and including an inside wall surface adapted to receive said undercut surface, and iv) a lock means for attaching said lock ring portion to said ladle, said lock means capable of positioning said lock ring segment along the length of said undercut surface to a selected depth "D".

17. The invention recited in claim 16 wherein said nozzle segment is a nonmagnetic material.

18. The invention recited in claim 16 wherein said nozzle segment is a refractory material.

19. The invention recited in claim 16 wherein said lock ring segment is steel.

20. In a steelmaking ladle including an outer steel shell, an inner refractory lining having a well block, a mounting plate attached to said outer steel shell, and an slag sensor positioned between said well block and said mounting plate, the improvement comprising a two piece nozzle insert comprising:

a) a nozzle segment including;

i) a first end positioned within a bore extending through said well block, said first end being set in place with a bonding material interposed between said bore and said nozzle segment, ii) a second end extending past said slag sensor and including an undercut surface, and iii) a discharge bore extending between said first end and said second end, and b) a lock ring segment including;

i) a top surface, ii) a bottom surface, iii) an aperture extending between said top surface and said bottom surface and including an inside wall surface adapted to receive said undercut surface, and iv) a lock means for attaching said lock ring portion to said ladle, said lock means capable of positioning said lock ring segment along the length of said undercut surface to a selected depth "D".

21. The invention recited in claim 20 wherein said lock means comprises:

a) a male connector comprising two or more pins extending in an outward direction from said lock ring segment, and b) a female connector comprising two or more grooves shaped to receive said pins, each said groove formed within said bore extending through said mounting plate and including a first end communicating with a bottom surface of said mounting plate and a second end formed within said bore, each said groove being a continuous inclined plane extending in an upward direction from said first end to said second end.

22. The invention recited in claim 20 wherein said nozzle segment is a material which will not interfere with the operation of said slag sensor.

23. The invention recited in claim 20 wherein said nozzle segment is a refractory material.

24. The invention recited in claim 20 wherein said lock ring segment is steel.

* * * * *